US006370707B1

(12) United States Patent
Parsons et al.

(10) Patent No.: US 6,370,707 B1
(45) Date of Patent: Apr. 16, 2002

(54) SUPPLY-LINE-SEALED FLUSH CONTROLLER

(75) Inventors: Natan E. Parsons, Brookline; Kay Herbert, Winthrop; Robert S. Shamitz, Brighton, all of MA (US)

(73) Assignee: Arichell Technologies, Inc., West Newton, MA (US)

( * ) Notice: Subject to any disclaimer, the term of this patent is extended or adjusted under 35 U.S.C. 154(b) by 0 days.

(21) Appl. No.: 09/761,533

(22) Filed: Jan. 16, 2001

(51) Int. Cl.[7] ..... E05D 1/34
(52) U.S. Cl. ..... 4/379; 4/378; 251/29
(58) Field of Search ..... 4/379, 380, 354, 4/366, 367, 361; 251/41, 29

(56) References Cited

U.S. PATENT DOCUMENTS

| | | | | |
|---|---|---|---|---|
| 2,760,204 A | * | 8/1956 | Joanis | 4/367 |
| 2,858,546 A | | 11/1958 | Tekenos et al. | |
| 3,628,195 A | * | 12/1971 | Skousgaard | 4/354 |
| 3,677,294 A | * | 7/1972 | Gibbs et al. | 137/572 |
| 3,817,279 A | | 6/1974 | Larson | |

(List continued on next page.)

FOREIGN PATENT DOCUMENTS

| | | |
|---|---|---|
| EP | 312750 B1 | 4/1991 |
| EP | 0828103 A1 | 3/1998 |
| GB | 1332995 | 10/1973 |
| GB | 2277108 A | 10/1994 |
| GB | 2277750 A | 11/1994 |
| GB | 2329452 A | 3/1999 |
| WO | WO 98/06910 | 2/1998 |
| WO | WO 98/10209 | 3/1998 |

*Primary Examiner*—Gregory L. Huson
*Assistant Examiner*—Huyen Le
(74) *Attorney, Agent, or Firm*—Cesari and McKenna, LLP

(57) ABSTRACT

A remote valve (46) controls relief of pressure by way from a pilot-valve chamber (38) whose pressure in turn controls pressure relief pressure chamber (24) by which a pressurized-water source holds a flush valve (12) seated in a flush opening at the base of a toilet tank (18). An actuator chamber defined by a housing (74) and flexible diaphragms (72) and (94) contains an incompressible fluid, and the user's depression of a push button (44) causes that fluid to be displaced through a check valve (100) so as to displace a valve member (102), which is coupled to one of the flexible diaphragms, from a sealing position to an unsealing position, where it permits flow from a valve inlet (104) to a valve outlet (48). This relieves the pressure that holds the flush valve (12) closed. A spring (101) biases the valve member (102) to a rest position, to which it tends to return when the user releases the push button (44). But the check valve (100) restricts the incompressible fluid's flow path to a small bleed orifice (112). This imposes a time delay before valve member (102) can return to its sealing position and thus cause the flush valve (12) again to close. The time delay ensures adequate flushing flow.

3 Claims, 8 Drawing Sheets

U.S. PATENT DOCUMENTS

| | | | | |
|---|---|---|---|---|
| 3,817,489 | A | | 6/1974 | Caron et al. |
| 3,820,171 | A | | 6/1974 | Larson |
| 3,820,754 | A | | 6/1974 | Caron et al. |
| 4,034,423 | A | | 7/1977 | Milnes |
| 4,077,602 | A | | 3/1978 | Klessig |
| 4,141,091 | A | | 2/1979 | Pulvari |
| 4,193,145 | A | | 3/1980 | Gross et al. |
| 4,233,698 | A | | 11/1980 | Martin |
| 4,304,015 | A | | 12/1981 | Hubatka |
| 4,357,720 | A | | 11/1982 | Stahli |
| 4,575,880 | A | | 3/1986 | Burgess |
| 4,662,395 | A | | 5/1987 | Strangfeld |
| 4,756,031 | A | | 7/1988 | Barrett |
| 4,832,310 | A | | 5/1989 | Nestich |
| 4,941,215 | A | | 7/1990 | Liu |
| 5,003,643 | A | | 4/1991 | Chung |
| 5,005,226 | A | | 4/1991 | Basile et al. |
| 5,187,818 | A | | 2/1993 | Barrett, Sr. et al. |
| 5,313,673 | A | | 5/1994 | Saadi et al. |
| 5,335,694 | A | | 8/1994 | Whiteside |
| 5,341,839 | A | | 8/1994 | Kobayashi et al. |
| 5,361,426 | A | | 11/1994 | Martin |
| 5,400,446 | A | | 3/1995 | Bloemer et al. |
| 5,431,181 | A | | 7/1995 | Saadi et al. |
| 5,603,127 | A | | 2/1997 | Veal |
| 5,649,686 | A | | 7/1997 | Wilson |
| 5,652,970 | A | | 8/1997 | Wodeslavsky |
| 5,884,667 | A | | 3/1999 | North |
| 6,123,315 | A | * | 9/2000 | Keller ..... 251/41 |
| 6,263,519 | B1 | * | 7/2001 | Parsons et al. ..... 4/313 |

* cited by examiner

SUPPLY-LINE-SEALED FLUSH CONTROLLER

BACKGROUND OF THE INVENTION

1. Field of the Invention

The present invention is directed to toilet flushing. It finds particular application in tank-type flushers.

2. Background Information

Toilet flushers come in a wide arrange of designs. (We use the term toilet here in its broad sense, which encompasses what are variously referred to as toilets, water closets, urinals, etc.) Many designs are of the gravity type, which uses the pressure that results from the weight of water stored in a tank to flush the bowl and provide the siphoning action by which the bowl's contents are drawn from it. Any flusher of this type employs a main flush valve, which controls the release of water from the tank through the tank outlet that leads to the bowl. For the flusher to act effectively, that flush valve must remain open long enough to let the required amount of water flow from the tank into the bowl.

A popular way of achieving the proper flush-valve-opening duration is to employ a pivoting flush valve on which a timer cup is disposed. The valve is pivoted to unseat it, and water in the full flush tank fills the timer cup. This so weights the cup that it keeps the valve pivoted to the open position. An orifice in the timer cup allows water to leak from it when the tank level has fallen below that of the timer cup. After a length of time great enough to allow most of the liquid to drain from the timer cup, the flush valve then pivots back into its closed position.

Another popular approach, typically used in automatic toilets, is to use a timer circuit to time activation of a solenoid that controls the flush valve's operation. An advantage of many such installations is that they use line pressure to operate the flush valve and can therefore be arranged so that the flush valve seals more effectively than the typical manual flusher's.

Commonly assigned copending U.S. patent application Ser. No. 09/716,870 filed on Nov. 20, 2000, by Parsons et al. for a Timed Fluid-Linked Flush Controller and hereby incorporated by reference describes an approach to flush-duration control that does not require electrical timing circuitry and yet lends itself to more-effective flush-valve operation than most manually operated flush valves customarily afford. That approach employs a valve-operating mechanism of the type in which water-line pressure is admitted into a control chamber whose resultant pressure can be relieved through a control-chamber pressure-relief outlet. The flush valve seats very effectively because pressure in a control chamber holds the flush valve seated when the line pressure prevails in it. When that pressure is relieved, the valve opening mechanism opens the flush valve.

In the mechanism described in that application, the pressure is relieved by a pressure-relief valve disposed at a remote location and interposed in a pressure-relief conduit that extends from the control chamber's pressure-relief outlet to the remote location. When the remote valve is closed, it permits flow from the pressure-relief conduit and thereby prevents pressure relief in the control chamber. It is operable by manual depression from the closed state to an open state, in which it permits such a flow and therefore relieves pressure within the control chamber.

The way in which adequate flushing flow is ensured is that the remote valve is of the type that mechanically imposes a time delay between the user's releasing the push button and the remote valve's closing.

SUMMARY OF THE INVENTION

We have developed a particularly beneficial approach to the mechanical delay imposition. This approach employs a fluid linkage between a push button that the user depresses and a valve member that seals and unseals to control flow through the pressure-relief conduit. The fluid linkage is provided by an actuator chamber filled with an incompressible fluid. The chamber is defined by opposed movable walls respectively coupled to the push button and valve member. By pushing the button, the user displaces one wall and thereby causes the incompressible fluid and thus the wall coupled to the valve member. This displaces the valve member to an unseated position and thus permits pressure-relieving flow in the pressure-relief conduit.

In flowing to displace the valve member in the direction that causes it to unseal, at least part of the incompressible fluid flows through a check valve arranged to permit flow in that direction. When the user releases the push button, the actuation-chamber walls tend to return to rest positions, to which they are biased, but the check valve is arranged not to permit incompressible-fluid flow in the resultant direction. That flow must therefore occur through an alternate, higher-flow-resistance path. This imposes the delay needed to allow enough flushing flow, yet the check valve provides relatively low resistance in the forward path so that the user can push the button easily.

In one embodiment of this invention, the push-button assembly includes two different button members. The first of the button members is coupled to the actuation-chamber wall, while the second is so mounted as to bear against the first button member, and thereby cause the valve to open, when the user presses on the second one. The second button member's mounting also permits only a relatively small amount of travel, so the actuation-chamber displacement results in only a relatively short valve-operation delay and thus a relatively small flushing flow. If the user desires a more-complete flushing flow, he directly presses the first button member, which is so mounted as to permit more travel. This results in greater displacement of the actuation-chamber walls and therefore a longer delay in the valve member's return.

Preferably, the valve members are mounted in a frame that forms a plurality of guides that permit different amounts of travel, and the button members can selectively be mounted in different ones of the guides to provide different delays for different installations.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1:
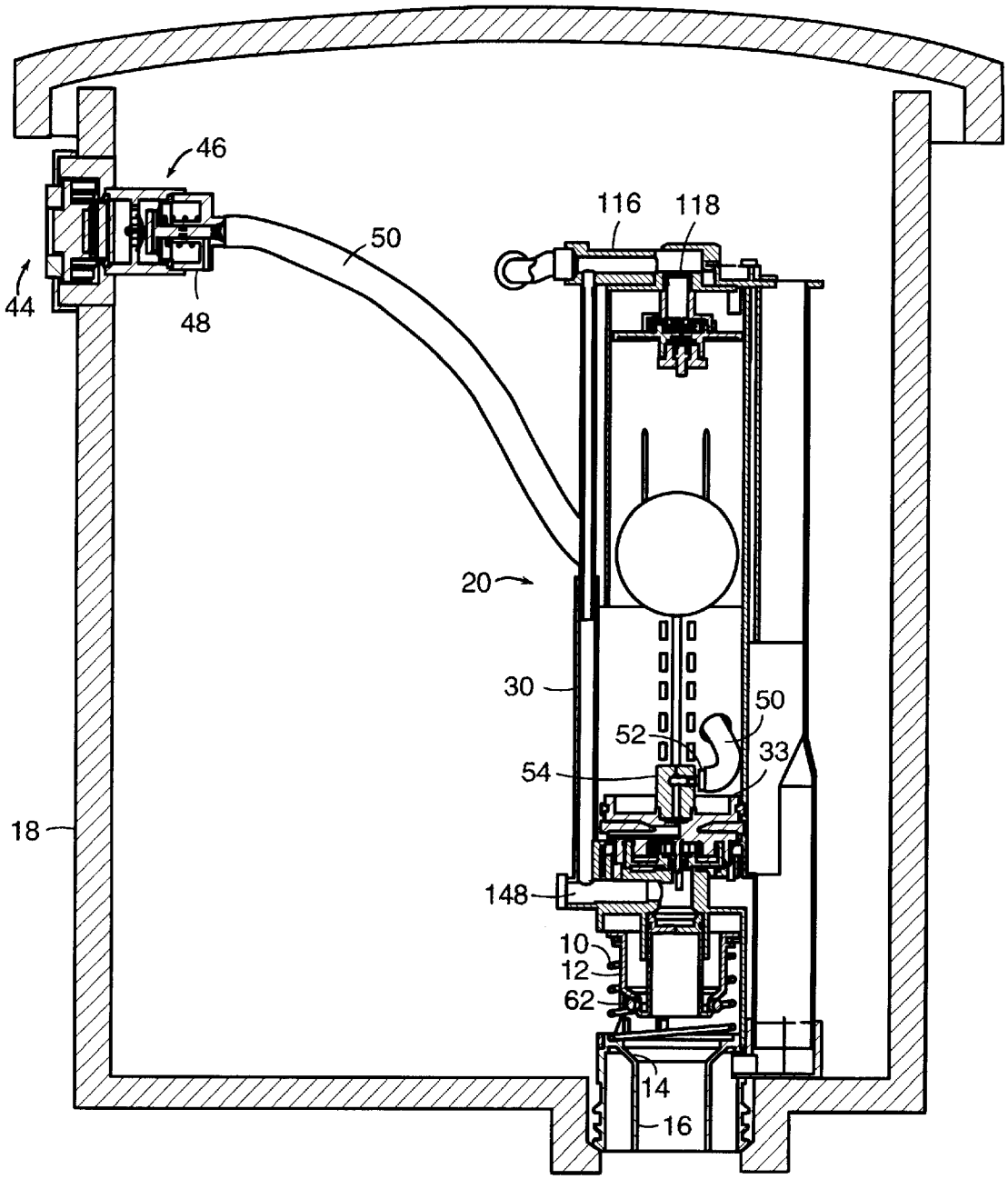
FIG. 1 is a sectional view of the toilet tank illustrating its float and gravity-type flush valves.
Figure 2:
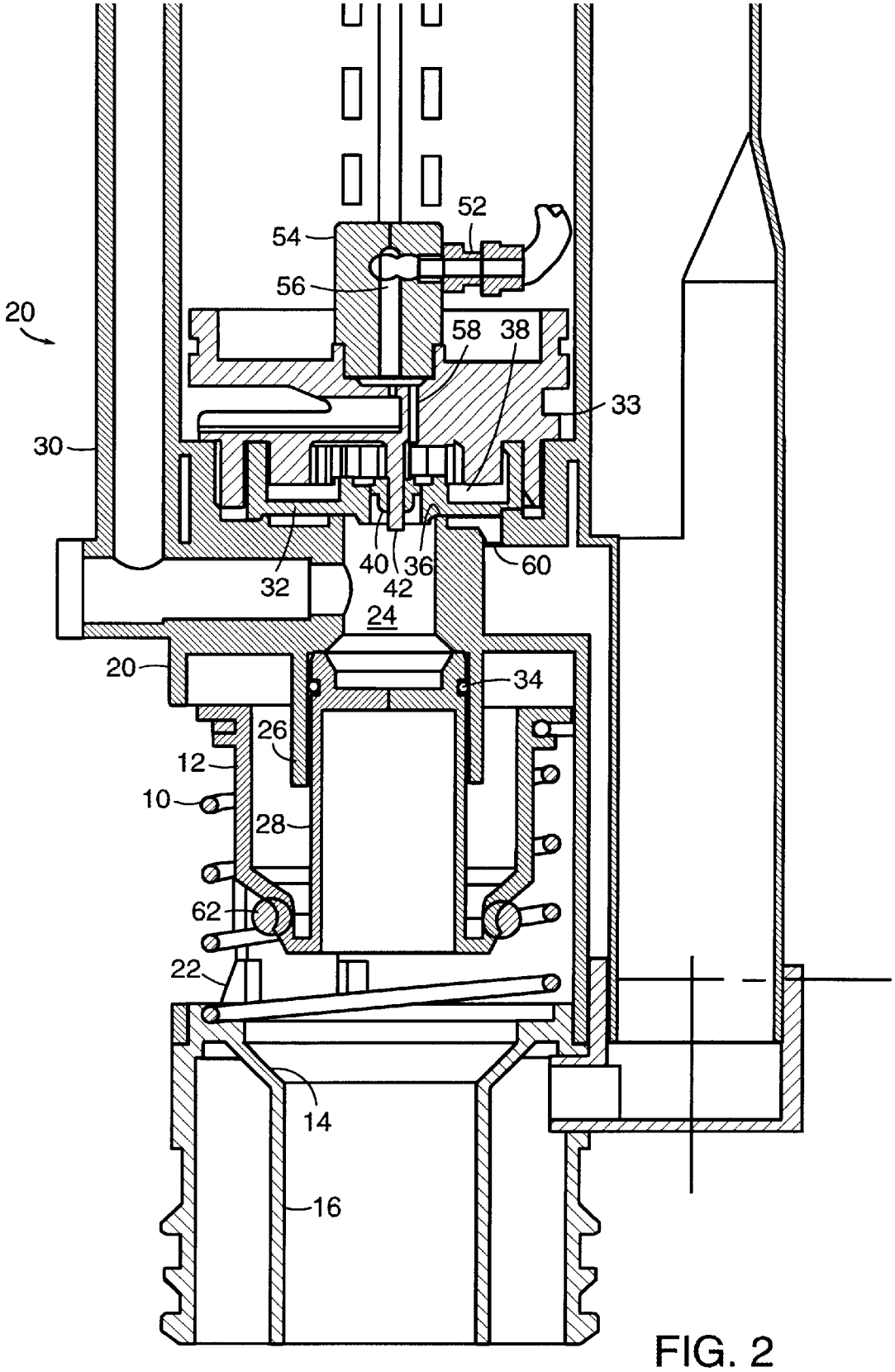
FIG. 2 is a more-detailed cross section of the flush-valve mechanism.

In the state that FIG. 1 depicts, a bias spring 10 keeps a gravity-type flush mechanism's flush-valve member 12 separated from a flush-valve seat 14 formed on the inlet of a flush conduit 16 disposed in the bottom of a toilet tank 18. As FIG. 2 shows in more detail, a lower main housing half 20 mounted by struts 22 on the flush conduit 16 forms a pressure chamber 24 above the valve member 12. The pressure chamber, which is partially defined by a cylinder 26 within which a piston portion 28 of the valve member 12 is slideable, is ordinarily under pressure because of fluid communication that a pressure line 30 provides between it and a pressurized-water supply. When that pressure prevails, it holds the valve member 12 in a seated position rather than the illustrated, unseated position.

Pressure chamber 24's pressure ordinarily prevails because a pilot-valve diaphragm 32 secured in housing half 20 by a pilot-valve cap 33 ordinarily cooperates with the valve member's seal ring 34 to prevent escape of pressurized water from the chamber. The pilot-valve diaphragm 32 is resiliently deformable, so the pressure that prevails within chamber 24 would tend to lift it from engagement with a pilot-valve seat 36 and thus allow pressure relief if a similar pressure did not prevail within a pilot chamber 38 and act on the diaphragm 32 over a greater area. The reason why this pressure prevails within the pilot chamber 38 is that a small orifice 40 through which a pilot-valve pin 42 formed by cap 33 extends permits water to bleed (through a relatively high flow resistance) into the pilot chamber. So the valve member 12 remains in the seated position (not shown) between flushes.

To cause the system to flush, the user depresses a push button 44 (FIG. 1). As will be explained in more detail below, this causes a remote pressure-relief valve 46 to permit flow to its outlet 48 from a pressure-relief tube 50 secured at its other end by a fitting 52 to a plug member 54 mounted on cap 33. This places the remote valve 46's outlet 48 in communication with a plug member 54's interior passage 56 (FIG. 2) and thereby with the pilot chamber 38 through passage 58. This relieves pressure in that chamber. The flow resistance of the path is much lower than that of the bleed orifice 40, by which the pilot valve's pressure is replenished, so the pressure within chamber 38 drops and permits pressure chamber 24's pressure to raise diaphragm 32 off its seat. The diaphragm thus serves as a pressure-relief valve. Specifically, it permits the pressure within the pressure chamber 24 to be relieved through a plurality of openings such as opening 60. As a consequence, the bias spring 10 can overcome the force exerted by the now-reduced pressure within chamber 24. The flush-valve member 12 therefore rises to its FIG. 1 position, lifting its O-ring seal 62 off the main valve seat 14 and thereby allowing water from the tank to flow out through the flush conduit 16.

Now, the user typically will may not keep the push button 44 depressed long enough for the required flush volume to flow. But the remote valve 46 nonetheless remains open long enough, as will now be explained by reference to FIG. 3. As that drawing shows, the push button 44 actually is a compound button consisting of outer and inner button members 64 and 66 held in a button frame 68 by a button cap 70. A flexible diaphragm 72 secured to the frame 68 by an actuator-chamber housing 74 biases the inner button 66 to the illustrated rest position, in which it additionally holds the outer button member 64 in its rest position.

Figure 4:
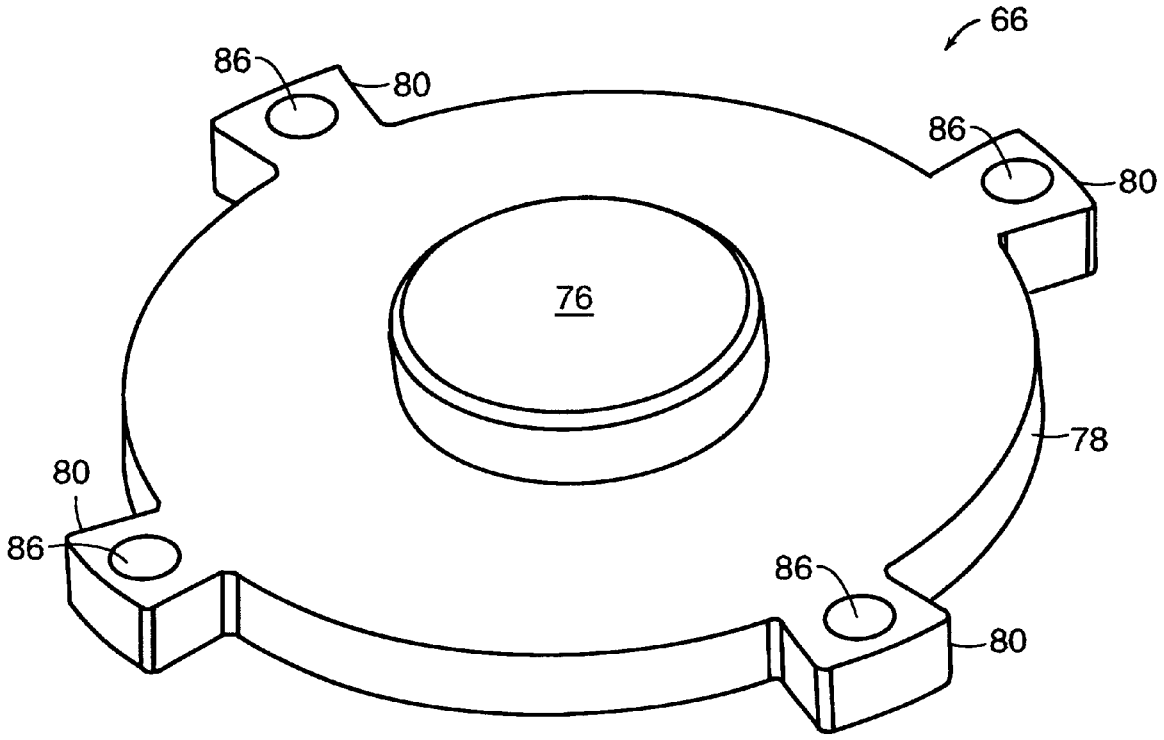
FIG. 4 is a top isometric view of one of the push-button members in the pushbutton assembly of FIG. 3.
Figure 5:
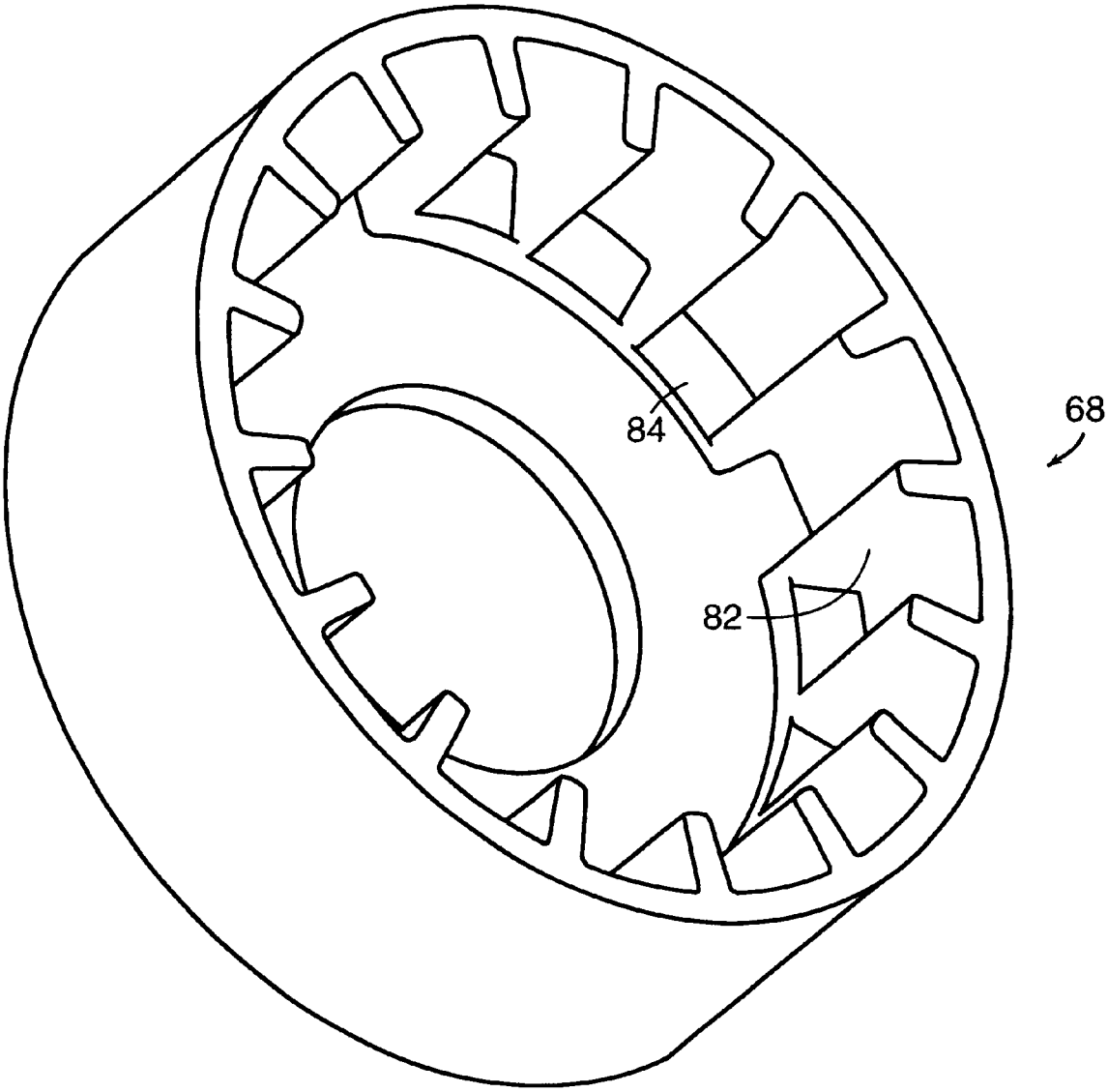
FIG. 5 is an isometric view of the button frame in FIG. 3's push-button assembly.

FIG. 4 is a top isometric view of the inner button member 66. That drawing shows that button member 66 includes a central land 76 extending from a generally disk-shaped layer 78 from which four keys 80 extend radially. As FIG. 5 shows, the button frame forms a set of sixteen partitions 82 extending radially inward. Those partitions 82 cooperate to define sixteen key guides, within any four of which FIG. 4's keys 80 can slide. The button frame 68 also forms stop surfaces 84 at the bases of the key guides thus formed. The stop surfaces 84 in the key guides occupied by the four keys at any one time are all arranged at the same level so that they stop all four keys simultaneously. But different sets of four stops are disposed at different levels so that placing the keys in different sets of the key guides results in different amounts of permitted button travel, for reasons that will be explained in due course.

Figure 6:
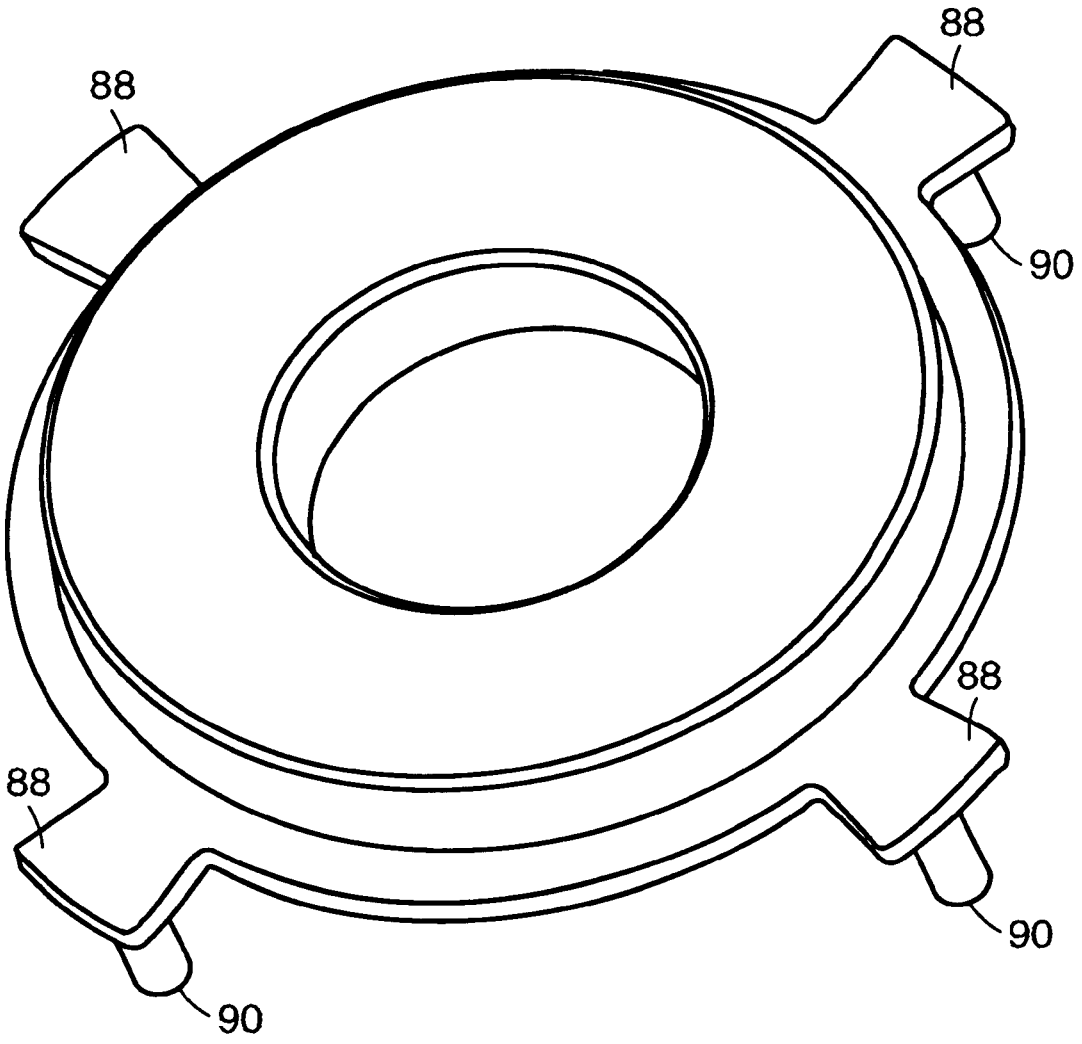
FIG. 6 is an isometric view of another button member from the push-button assembly of FIG. 3.

As FIG. 4 shows, each of the four keys 80 forms a passage 86 therethrough. FIG. 6, which is an isometric view of the outer button member 64, shows that the outer button member is generally annular but forms four radially extending tabs 88 from which respective legs 90 extend. Those legs register with FIG. 4's passages 84 and, as FIG. 3 shows, extend through them.

When the user operates the push button 44, he most often presses against the outer button member 64 and thereby depresses that member until its legs 90 reach the respective key guides' stop surfaces. The outer button member 64 bears against the inner button member 66, moving it to the right in FIG. 3 and causing it to deform the flexible diaphragm 72 from its illustrated position, to which it is biased. A valve housing 92 secured to the actuator-chamber housing 74 holds in place a second flexible diaphragm 94, which cooperates with diaphragm 72 and the actuator-chamber housing 74 to form an actuator chamber. The actuator chamber is filled with an incompressible fluid, and button member 66's deformation of diaphragm 72 forces the fluid through four angularly spaced openings 96 in a divider wall 98 that the actuator-chamber housing 74 forms. In flowing through openings 96, the fluid lifts the lip of an umbrella-type check-valve member 100 snap fit in a central divider-wall opening.

Figure 3:
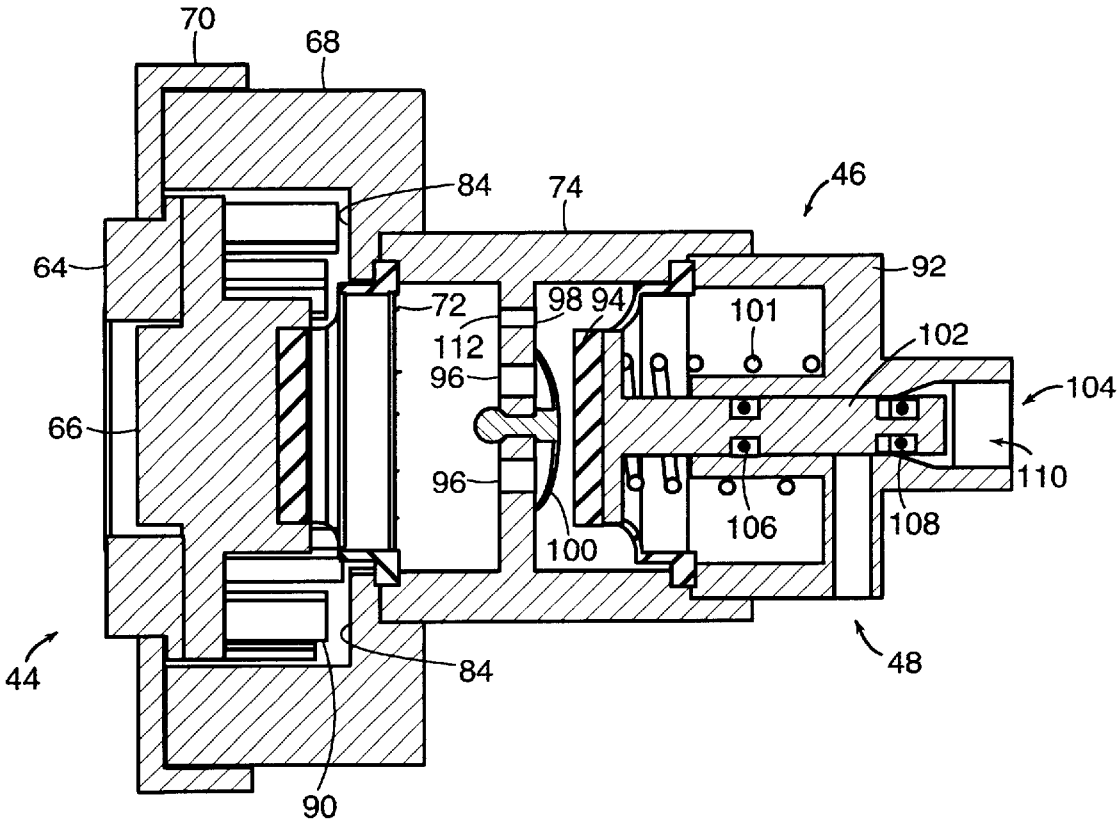
FIG. 3 is a cross-sectional view of a remote actuator valve and push button.

The fluid's motion urges diaphragm 94 rightward in FIG. 3 against the force of a bias spring 101 and thereby pushes to the right a valve member 102 slidably disposed in a valve channel 104 formed by the valve housing 92. Valve member 102 forms two annular recesses in which respective O-ring seals 106 and 108 are disposed, and the rightward motion causes O-ring 108 to extend into a widened portion 110 of channel 104 and thereby break the seal that it had theretofore maintained with the channel wall. Pressure theretofore prevailing in tube 50 is thereby relieved through channel 104 and outlet passage 48. When the user depresses only the outer button member 64, the point at which that members' legs 90 encounter their respective lands 84 determines how far into the widened channel portion 110 valve member 102 extends.

When the user releases the button, flexible diaphragms 72 and 94 tend to resume the rest positions to which spring 101 biases them, so they act to return the valve 46 to its closed state. To resume the rest positions, they must move the actuator chamber's fluid back through the dividing wall 98. But check valve 100 prevents fluid from flowing through openings 96, and the only route through the wall that remains is therefore a bleed orifice 112, which imposes significant flow resistance and therefore a delay between the user's releases of the button and valve 46's closure.

The duration of the delay depends on the amount of diaphragm deformation that occurred, and this in turn depends on how far button member 64 traveled. The amount of that travel is determined by the selection of the key guides into which that button member's keys 80 were placed; different-level stop surfaces 84 result in different amounts of travel of legs 90 before they encounter those stop surfaces, but the resultant delay is usually at least two seconds.

The delay imposed as a result of the user's depressing only the outer button member 66 is usually so selected as not to permit the tank to empty completely but still to permit enough flushing flow for most purposes. If the user desires a fuller flush, he instead depresses the inner button member 66's land 76 (FIG. 4). Button member 66 can travel farther than member 64; it can travel until its keys 80 reach respective stop surfaces 84. As a consequence, its operation causes more of the incompressible fluid to flow through the divider wall 98, and it thus requires more of the fluid to return upon the button's release before the valve 46 returns to its closed position. More of the tank's contents therefore flow into the toilet bowl to flush it.

Figure 7:
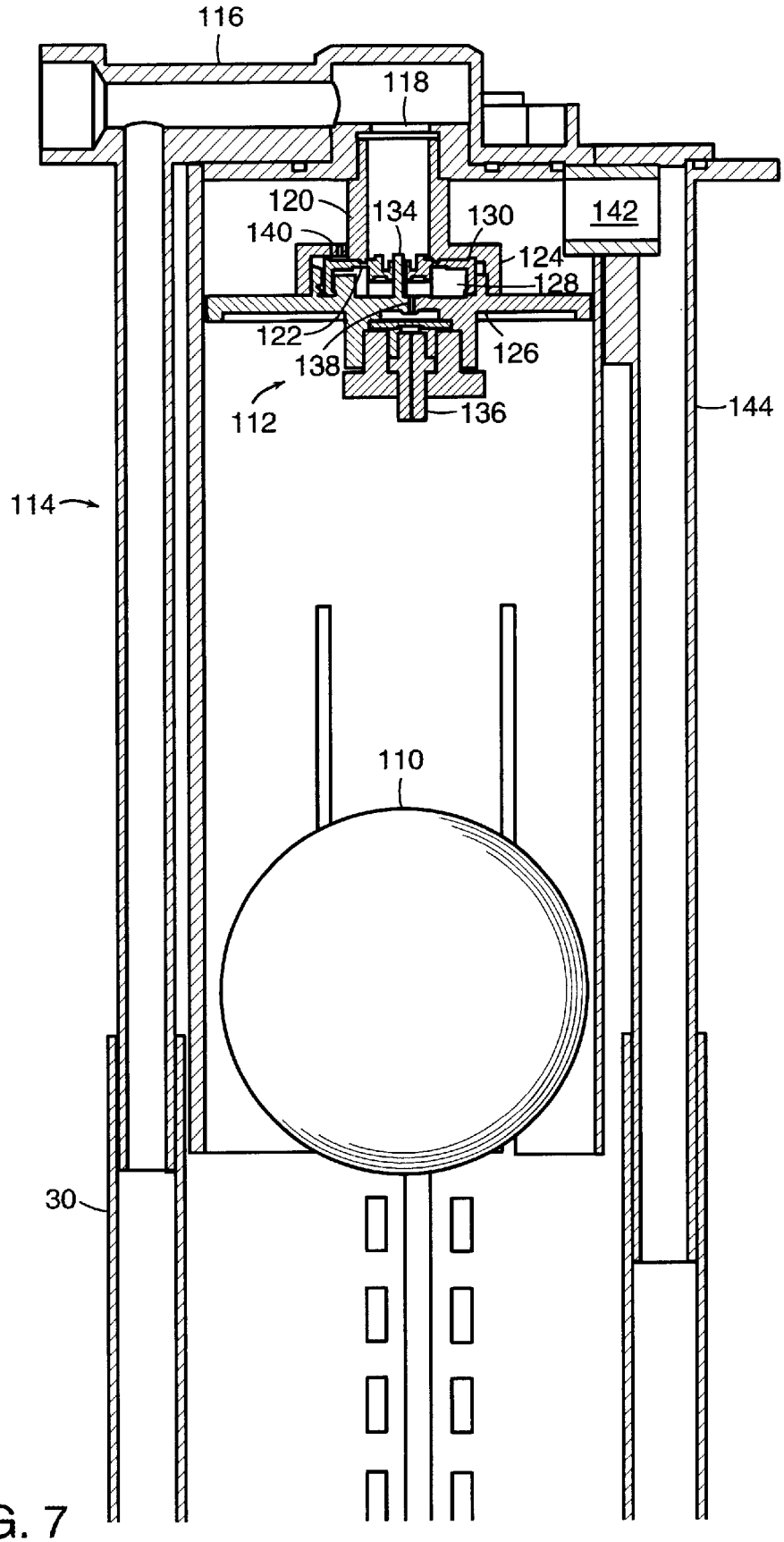
FIG. 7 is a more-detailed cross-sectional view of FIG. 1's float-valve assembly.

When the water level in the tank has fallen significantly below a full-tank level, a float 110 shown in FIG. 7 permits the float valve 112 to open. That valve is mounted in an upper main-housing half 114 supported on the lower main-housing half. The main housing is provided in two halves so that the float-valve assembly 112's height, and thus the level to which the tank is allowed to fill, can be adjusted by means not shown.

A main pressure-inlet manifold 116, which feeds the conduit 30 by which pressure chamber 24 is pressurized, forms a further outlet 118. Through this outlet it feeds a conduit 120 mounted on the upper main-housing half 114 and forming at its lower edge a float-valve seat 122. Formed integrally with the conduit 120 is a generally annular mouth portion 124 in which a pilot-chamber base 126 is threadedly secured. That base cooperates with the conduit 120's mouth portion 124 to form a float-valve pilot chamber 128 and secure within it a resiliently deformable float-valve diaphragm 130 that tends to seal against the float-valve seat 122. However, a bleed orifice in which is disposed a positioning pin 134 formed by the pilot-chamber base 126 permits fluid from the conduit 120 to enter the pilot-valve chamber 128. When a pilot-valve member 136 is held by the float 110 against the outlet of a pressure-relief passage 138, the pressure in the pilot-valve chamber 128 can build up to equal the pressure in the conduit 120 and, prevailing over a larger area than the pressure from the conduit 120, hold the float-valve diaphragm 130 seated so that it prevents the liquid in conduit 120 from flowing around the float-valve seat 122 through mouth-portion openings 140 and a port 142 to a tank-fill tube 144.

When the tank level is low, though, the float 110 does not stop pressure-relief passage 138, so pressure in the pilot-valve chamber 128 is relieved faster than it can be restored through the bleed orifice 132. The pressure in conduit 120 therefore unseats the float-valve diaphragm 130, so water from conduit 120 can flow into the fill tube 144.

Figure 8:
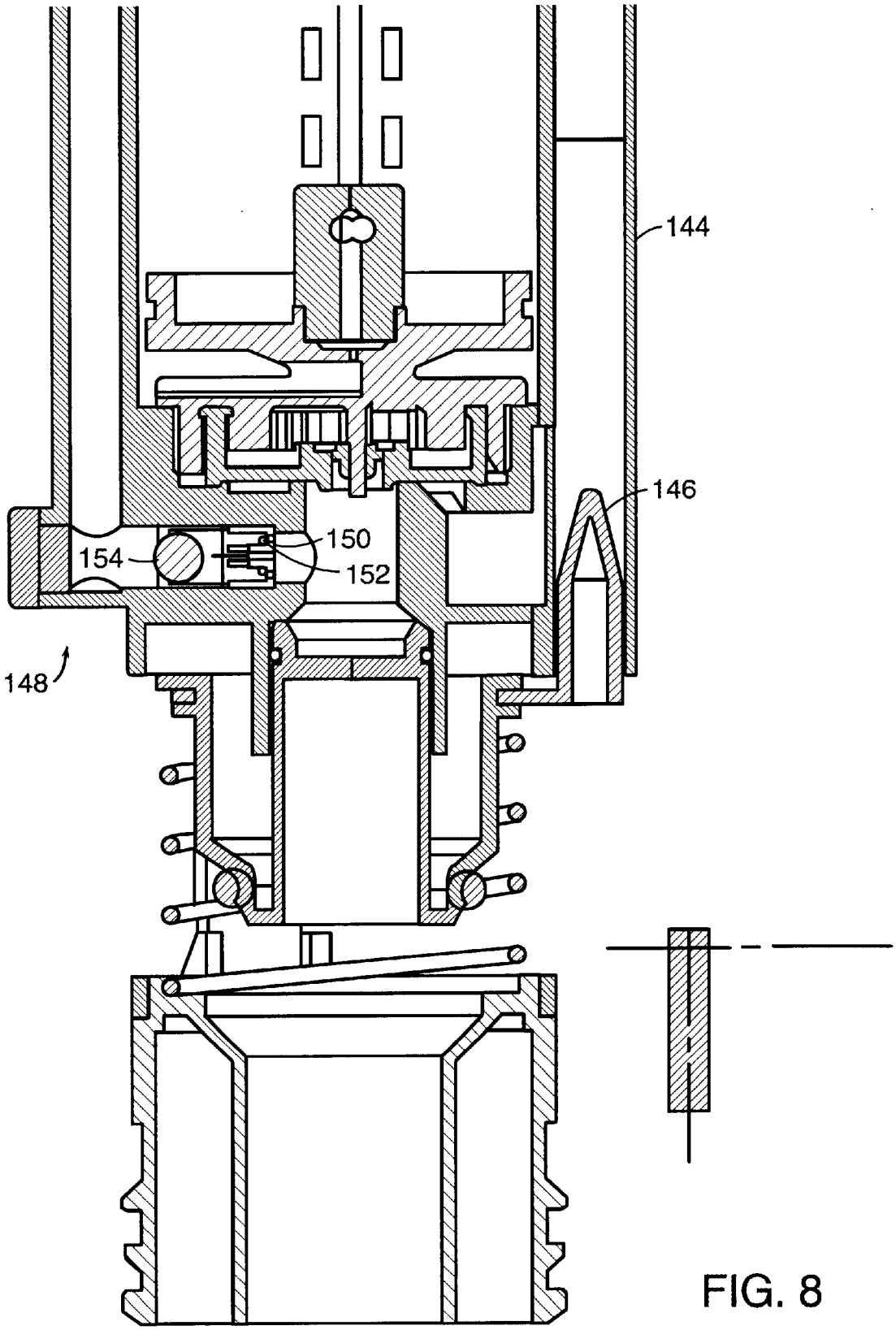
FIG. 8 is a cross-sectional view of the flush-valve assembly showing a fill tube and flow diverter.

The fill tube's purpose is to fill the tank, and the tank-filling flow tends to reduce the manifold pressure. Since that pressure is what closes the flush valve, significant tank-filling flow might impair that valve's closing performance. So long as the flush-valve member 12 is in its fully unseated position, though, water cannot flow at any significant rate from the fill tube 144 into the tank. This is because, as FIG. 8 shows, a flow restricter 146 mounted on the flush-valve member so protrudes into the fill tube's outlet as to restrict the tube's flow area greatly. This has the beneficial effect of maintaining high pressure in the manifold 116 and thus the pressure line 130 by which, through bleed orifice 140, the manifold pressure closes the pilot valve and thus imposes on the flush valve the pressure that closes it. In other words, the flow restricter ensures that there is enough pressure to close the flush valve with significant speed.

When the flush valve does close, it retracts the flow restricter 146 from the fill tube 144 and thereby allows the tank to fill rapidly.

The flow-restricter operation just described tends to make the flush valve's operation more predictable in duration than it would otherwise be; tank filling does not adversely affect the pressure that operates to close the flush valve. However, the pressure from the water source can vary, and this, too, could result in undesired variations in the delay between the remote valve's closing and that of the flush valve. A flow-rate controller 148 (FIG. 1) interposed in the flow path by which the flush-valve-closing pressure is supplied reduces this effect. The particular type of flow controller is not critical, but FIG. 8 depicts one of the deformable-ring variety. A flow restricter 150 disposed in the conduit cooperates with a resiliently deformable ring 152 to restrict the flow area through which pressurized water must flow to enter the pressure chamber that applies the closing force to the flush valve. If the supply pressure is relatively low, it does not greatly deform the ring, and the resultant flow area is relatively great: the already-low pressure is not reduced much in flowing through the restricter. If the supply pressure is high, on the other hand, it deforms the ring by a greater amount and thereby restricts the flow area more significantly. So a greater pressure drop from the originally high pressure occurs. The flow-rate controller therefore reduces the pressure variation that the flush valve would otherwise experience. This reduces variation in the speed at which the flush valve closes.

Plumbing installations can experience not only pressure variation but also total pressure loss. In the absence of the present invention, such a pressure loss would permit the flush valve to open, causing an unintended flush. But a check valve 154 is provided in the pressurizer conduit 30 so that the pressure holding the flush valve closed is not lost when the line pressure is.

What is claimed is:

1. A flusher comprising:

A) a tank forming a flush outlet by which liquid in the tank may leave the tank for flushing;

B) a flush-valve member operable between an unseated state, in which it permits flow from the tank through the flush outlet, and a seated state, in which it prevents flow from the tank therethrough;

C) a valve-operating mechanism including a housing that defines a control chamber disposed at a local location and forms a line-pressure inlet that admits water line pressure into the control chamber and further forms a control-chamber pressure-relief outlet, by which pressure in the control chamber can be relieved, the valve-operating mechanism operating the flush-valve member to its seated state when the line pressure prevails in the control chamber and operating the flush-valve member to its unseated state when the pressure in the control chamber is relieved, the valve-operating mechanism further including:

i) a pressure-relief conduit extending from the control-chamber pressure-relief outlet to a remote location and thereby providing a pressure-relief path, and ii) a remote valve, disposed at the remote location, interposed in the pressure-relief path, and including:

a) chamber walls, including first and second displaceable walls, forming a closed actuator chamber;

b) an incompressible fluid that fills the actuator chamber;

c) a remote-valve member coupled to the second displaceable wall for displacement therewith between a closed state, to which it is biased and in which it prevents flow through the pressure-relief conduit and thereby prevents relief of pressure within the control chamber, and an open state, in which it permits relief of pressure within the control chamber;

d) a push button displaceable by manual depression and so coupled to the first displaceable wall as to displace the first displaceable wall and thereby the incompressible fluid, the second displaceable wall, and the valve to the open state;

e) an actuation-chamber divider that divides the actuator chamber into first and second chamber segments in which the first and second displaceable walls are respectively located, the divider providing for asymmetric flow therethrough such that it exhibits such higher flow resistance to flow of the incompressible fluid therethrough from the second chamber segment to the first chamber segment than from the first chamber segment to the second chamber segment as to impose a time delay of at least two seconds between release of the push button and the remote-valve member's closure of the pressure-relief path.

2. A flusher as defined in claim 1 wherein:

A) the actuation-chamber divider includes:

i) a divider wall forming forward and reverse passages therethrough; and ii) a check valve positioned and oriented to permit flow from the first chamber segment through the forward passage to the second chamber segment but not from the second chamber segment through the forward passage to the first chamber segment; and B) the incompressible fluid flows through the reverse passage when the displaceable walls are displaced by the remote-valve member's assuming its closed state.

3. A flusher as defined in claim 1 wherein the remote-valve assembly includes a plurality of button guides, in a subset of which the push button is mounted, that admit of different amounts of button travel.

* * * * *